US012129581B2

(12) United States Patent
Frahmann et al.

(10) Patent No.: US 12,129,581 B2
(45) Date of Patent: Oct. 29, 2024

(54) ROTATIONAL BRAIDING MACHINE

(71) Applicant: BIZLINK INDUSTRY GERMANY GMBH, Roth (DE)

(72) Inventors: Arno Frahmann, Kleefeld (DE); Hüseyin Turan, Garrel (DE); Maik Stratmann, Friesoythe (DE)

(73) Assignee: BIZLINK INDUSTRY GERMANY GMBH, Roth (DE)

( * ) Notice: Subject to any disclaimer, the term of this patent is extended or adjusted under 35 U.S.C. 154(b) by 87 days.

(21) Appl. No.: 17/911,448

(22) PCT Filed: Mar. 19, 2021

(86) PCT No.: PCT/EP2021/057056
§ 371 (c)(1),
(2) Date: Sep. 14, 2022

(87) PCT Pub. No.: WO2021/191066
PCT Pub. Date: Sep. 30, 2021

(65) Prior Publication Data

US 2023/0132310 A1 Apr. 27, 2023

(30) Foreign Application Priority Data

Mar. 24, 2020 (DE) ..... 102020108046.8

(51) Int. Cl.
*D04C 3/42* (2006.01)
*D04C 3/38* (2006.01)
*D04C 3/46* (2006.01)

(52) U.S. Cl.
CPC ..... *D04C 3/42* (2013.01); *D04C 3/38* (2013.01); *D04C 3/46* (2013.01)

(58) Field of Classification Search
CPC ..... D04C 3/38; D04C 3/42; D04C 3/46
See application file for complete search history.

(56) References Cited

U.S. PATENT DOCUMENTS 7,270,043 B2 * 9/2007 Presz, Jr. ..... D04C 3/38 87/48
2015/0299916 A1 10/2015 Reinisch
(Continued)

FOREIGN PATENT DOCUMENTS

DE 317415 A 7/1915
DE 489303 C 1/1930
(Continued)

OTHER PUBLICATIONS

Machine Translation DE 489303 C, retrieved Feb. 6, 2024.*

*Primary Examiner* — Shaun R Hurley
(74) *Attorney, Agent, or Firm* — Tarolli, Sundheim, Covell & Tummino LLP

(57) ABSTRACT

A rotational braiding machine (100) has a plurality of first braiding material carriers (200*a*), a plurality of second braiding material carriers (200*b*), a movement unit, a drive and a controller. The movement unit is arranged and designed in order to move relocating elements (300) associated with the first braiding material carriers (200*a*) in each case between a first position and a second position. The drive is designed to drive the plurality of first braiding material carriers (200*a*) such that they rotate about the common braiding center in a first rotation direction and to drive the plurality of second braiding material carriers (200*b*) such that they rotate about the common braiding center in a second rotation direction which is different from the first rotation direction. The controller is additionally designed to control the movement unit such that the movement of at least one of the relocating elements (300) can be adjusted.

13 Claims, 4 Drawing Sheets

(56) References Cited

U.S. PATENT DOCUMENTS

| | | | | |
|---|---|---|---|---|
| 2017/0233908 | A1* | 8/2017 | Kroczynski ..... | D04C 3/42<br>87/48 |
| 2018/0274170 | A1 | 9/2018 | Falkenberg et al. | |

FOREIGN PATENT DOCUMENTS

| | | | | |
|---|---|---|---|---|
| DE | 10231302 | A1 | 1/2004 | |
| DE | 102010035883 | A1 * | 3/2012 | ..... D04C 3/44 |
| DE | 102014016832 | B3 | 1/2016 | |
| EP | 03416772 | A2 | 11/1989 | |

* cited by examiner

ROTATIONAL BRAIDING MACHINE

RELATED APPLICATIONS

This application filed under 35 U.S.C § 371 is a national phase application of International Application Number PCT/EP2021/057056, filed Mar. 19, 2021, which claims the benefit of German Application No. 10 2020 108 046.8 filed Mar. 24, 2020, the subject matter of which are incorporated herein by reference in their entirety.

TECHNICAL FIELD

The present invention relates to a rotational braiding machine and to a method for operating such a rotational braiding machine.

BACKGROUND

Braiding machines for braiding a braiding material are known from the state of the art. Known braiding machines are based in principle on a similar idea. To form a braid, braiding material carriers carrying the braiding material, such as bobbin carriers, for example, must be led around one another in a defined pattern to achieve the interlacing of the braiding material. The braiding material can be wire or yarn, for example. The braiding material is unwound in this case from the braiding material carriers and is bundled by a ring. The finished braid is formed inside this ring. The point at which braid formation is completed, thus the braiding material is compacted to its final width and has reached its final position within the textile, is termed the braiding point. A drawing-off device conveys the finished braid out of the machine. The movement of the braiding material carriers (e.g., the bobbin movement) and the conveying of the braid must take place at speeds precisely matching one another so that the desired braiding angle is maintained in the product.

Two different concepts of how the movement of the braiding material carriers and the interlacing of the braiding material can be solved in terms of design engineering are used in today's braiding machines—the bobbin braiding technique and the rotational braiding technique. The rotational braiding technique is based on the recognition that the speed of known bobbin braiding machines would not be increased significantly on account of the oscillating bobbin movement. A design principle for braiding machines was therefore sought in which the braiding material carriers rotate uniformly about the braiding center. The rotational braiding technique permits considerably higher production speeds and is therefore also called the high-speed braiding technique.

In the rotational braiding technique, the two groups of braiding material carriers (e.g., bobbin carriers) on which the braiding material is stored each move on a circular track in opposite directions about the braiding center. The two tracks are arranged such that the wire from the braiding material carriers of one circulating direction is drawn off directly to the braiding point. This track is often termed the inner track and corresponds to a simple rotatory movement. The braiding material coming from the braiding material carriers of the other track, often termed the outer track, must now be guided past alternately above or below the braiding material carriers approaching on the inner track to achieve the interlacing of the braid. The braiding material coming from the outer braiding material carriers switches multiple times from the bottom to the top position in the course of circling the machine center so that they can pass below or above the inner bobbins. The change of position does not have to take place after each passing of a braiding material carrier of the other running direction; several can also be passed consecutively. The weave structure of the braid can be influenced in this way. The control of the braiding material is realized by means of what is called a relocating unit, the constructional implementation of which can be different depending on the construction principle of the machine.

The result of such braiding is a crossing of the braiding material, such as of single and plied wires, for example, running axially. Known rotational braiding machines can only produce braids with a constantly identical course of interlacing. A braid with a crossing running differently cannot be manufactured using known rotational braiding machines.

A requirement therefore exists for an improved rotational braiding machine and an associated method. In particular, a requirement exists for a rotational braiding machine and an associated method that enable the production of braids with more resistant characteristics in the case of mechanical stresses and/or different crossing regimes.

SUMMARY

A first aspect of the present invention relates to a rotational braiding machine. The rotational braiding machine has a plurality of first braiding material carriers, a plurality of second braiding material carriers, a movement unit, a drive and a controller. The plurality of first braiding material carriers is arranged around a common braiding center of the rotational braiding machine. The plurality of first braiding material carriers is designed in each case to carry braiding material to be braided in the common braiding center. The plurality of second braiding material carriers is arranged around the common braiding center of the rotational braiding machine. The plurality of second braiding material carriers is designed in each case to carry braiding material to be braided in the common braiding center. The movement unit is arranged and designed to move relocating elements respectively associated with the first braiding material carriers between a first position and a second position in each case. Each of the relocating elements is able to raise the braiding material in the first position in such a way that at least one of the plurality of second braiding material carriers can pass under the raised braiding material. Each of the relocating elements is able to lower the braiding material in the second position in such a way that at least one of the plurality of second braiding material carriers can pass over the lowered braiding material. The drive is designed to drive the plurality of first braiding material carriers such that they rotate in a first direction of rotation about the common braiding center. The drive is designed to drive the plurality of second braiding material carriers such that they rotate about the common braiding center in a second direction of rotation different from the first rotation direction. The controller is designed to control the movement unit such that the movement of at least one of the relocating elements is adjustable. For example, the controller can be designed to control the movement unit such that the movement of each of the relocating units is adjustable. The controller can be designed, for example, to control the movement unit such that the movement of at least one of the relocating units is adjusted by the controlling. For example, the controller can be designed to control the movement unit such that the movement of each of the relocating units is adjusted by the controlling. The adjustment of the movement of the relocating units can take place in particular during a braiding process, i.e., while the rotational braiding machine is in operation.

A second aspect of the invention relates to a method for operating a rotational braiding machine. The rotational braiding machine has a plurality of first braiding material carriers, a plurality of second braiding material carriers, a movement unit, a drive and a controller. The plurality of first braiding material carriers is arranged around a common braiding center of the rotational braiding machine. The plurality of first braiding material carriers is designed in each case to carry braiding material to be braided in the common braiding center. The plurality of second braiding material carriers is arranged around the common braiding center of the rotational braiding machine. The plurality of second braiding material carriers is designed in each case to carry braiding material to be braided in the common braiding center. The movement unit is arranged and designed to move relocating elements respectively associated with the first braiding material carriers between a first position and a second position in each case. Each of the relocating elements is able to raise the braiding material in the first position in such a way that at least one of the plurality of second braiding material carriers can pass under the raised braiding material. Each of the relocating elements is able to lower the braiding material in the second position in such a way that at least one of the plurality of second braiding material carriers can pass over the lowered braiding material. The method has driving of the plurality of first braiding material carriers such that the plurality of first braiding material carriers rotates in the first rotation direction about the common braiding center. The method further has driving of the plurality of second braiding material carriers such that the plurality of second braiding material carriers rotates about the common braiding center in a second rotation direction different from the first rotation direction. The method further has control of the movement unit such that the movement of at least one of the relocating elements is adjustable. The method can have control of the movement unit in such a way, for example, that the movement of each of the relocating units is adjustable. The method can have control of the movement unit, for example, such that the movement of at least one of the relocating units is adjusted by the controlling. The method can have control of the movement unit, for example, such that the movement of each of the relocating units is adjusted by the controlling.

For reasons of clarity, the present invention is described below with the primary focus on the rotational braiding machine according to the first aspect, wherein the following explanations apply accordingly to the method for operating the rotational braiding machine according to the second aspect.

The braiding center can also be described as the braiding point. The plurality of first and/or second braiding material carriers can be driven in such a way that they rotate about the common braiding point. The first and/or second braiding material carriers can each carry braiding material to be braided. The first and/or second braiding material carriers can each be formed as bobbin carriers and each carry the braiding material to be braided on bobbins.

Due to an alternating/oscillating raising and lowering of the braiding material by means of the relocating elements associated with the first braiding material carriers, it is possible, by passing of at least one of the plurality of second braiding material carriers under the raised braiding material and/or by passing of at least one of the plurality of second braiding material carriers over the lowered braiding material, for the braiding material to be braided in the braiding center into a braid. The relocating elements can be raised and lowered by means of the movement unit. It can be said here that a run of a relocating element is complete when the movement unit has moved the relocating element from the first position into the second position and then back into the first position. The speed and/or frequency of the movement or of a run of the relocating elements influences the crossing points of the braiding material and consequently the design/interlacing pattern of the braid.

According to a first exemplary embodiment of the rotational braiding machine according to the first aspect, the movement unit can have a rotatable cam ring or is formed as a rotatable cam ring. The movement of the relocating elements can be adjusted by rotation of the cam ring. For example, the movement of the relocating elements can be adjusted by changing the rapidity of the movement of the cam ring.

The controller can be designed to control the movement unit in that the controller causes the drive to drive the rotatable cam ring such that the rotatable cam ring rotates in the first rotation direction about the common braiding center (rotation center) at a cam ring rotational speed. The controller can be designed to cause the drive to drive the plurality of first braiding material carriers such that they rotate in the first rotation direction about the common braiding center at a first rotational speed that takes the cam ring rotational speed into account. The controller can be designed to cause the drive to drive the plurality of second braiding material carriers such that they rotate in a second rotation direction different from the first rotation direction about the common braiding center at a second rotational speed that takes the cam ring rotational speed into account.

A curved path can be arranged in the cam ring. The relocating elements can be raised and lowered according to the course of the curved path. The movement of the relocating elements can be adjusted, for example, by a change in the curved path of the cam ring. If the curved path is invariable during a braiding process, the movement of the relocating elements can be adjusted during the braiding process by a change in the rotation of the cam ring.

It can be understood by the first rotational speed taking the cam ring rotational speed into account that the first rotational speed is coordinated to the cam ring rotational speed. For example, it can be understood by the first rotational speed taking the cam ring rotational speed into account that the first rotational speed is coordinated to the curved path in the cam ring such that the relocating elements can execute their respectively predetermined oscillating raising and lowering of the braiding material with/despite rotation of the cam ring. It can be understood by the second rotational speed taking the cam ring rotational speed into account that the second rotational speed is coordinated to the cam ring rotational speed. For example, it can be understood by the second rotational speed taking the cam ring rotational speed into account that the second rotational speed is coordinated to the curved path in the cam ring such that the relocating elements can execute their respectively predetermined oscillating raising and lowering of the braiding material with/despite rotation of the cam ring.

In normal operation, the cam ring rotational speed is, in particular, greater than 0. The cam ring rotational speed can be smaller than or equal to the first rotational speed. The cam ring rotational speed can be smaller than or equal to the second rotational speed in terms of amount. In normal operation, the cam ring rotational speed is (much) smaller than the first rotational speed. In normal operation, the cam ring rotational speed is (much) smaller in terms of amount than the second rotational speed.

The drive can have a cam ring drive. The cam ring drive can be designed to drive the cam ring such that the cam ring rotates in the first rotation direction at the cam ring rotational speed about the common braiding center. The cam ring drive can be designed as an electric drive.

The rotational braiding machine can also have a slewing ring. The axis of rotation of the slewing ring can correspond to the braiding center/braiding point. The cam ring can be supported on the slewing ring. Rotation of the slewing ring at one rotational speed can cause a rotation of the cam ring at, for example, the same rotational speed.

The rotational braiding machine can also have a gear connected to the cam ring drive and the slewing ring. The gear can be designed to transmit the energy provided by the cam ring drive to the slewing ring. The gear can be designed as a belt drive or a gearwheel drive. For example, the gear can mesh with the slewing ring or engage in the slewing ring. The gear can be moved by the cam ring drive and set the slewing ring in rotation via its own movement.

According to a second exemplary embodiment of the rotational braiding machine according to the first aspect, which can be realized independently of the first exemplary embodiment of the rotational braiding machine or in combination with the first exemplary embodiment of the rotational braiding machine, the movement unit can be designed at least as a relocating element drive or can have at least one relocating element drive.

The movement of one or more of the relocating elements can be adjusted by the at least one relocating element drive. For example, the rapidity of the movement of one or more of the relocating elements can be adjusted. The controller can be designed to control the movement unit in that the controller causes the at least one relocating element drive to adjust the movement of the at least one relocating element, for example of all relocating elements.

According to a first possible configuration of the second exemplary embodiment, the at least one relocating element drive, configured for example as a single relocating element drive, can adjust the movement of each of the relocating elements collectively. According to a second possible configuration of the second exemplary embodiment, the at least one relocating element drive can be configured, for example, as a plurality of relocating element drives, which are each associated with one of the relocating elements. Each of the relocating element drives can adjust the movement of its associated relocating element accordingly. For example, the at least one relocating element drive can have one or more servomotors or electromagnetic drives or can be designed as such. Each of the servomotors or electromagnetic drives can be associated with a related relocating element and can adjust the movement of the related relocating element based on a control signal or control command received from the controller.

By adjusting the movement of at least one of the relocating elements, the crossing points of the braiding material and consequently the configuration/the interlacing pattern of the braid can be influenced.

The first braiding material carriers can be designed as what are termed outer braiding material carriers of the rotational braiding machine. The second braiding material carriers can be designed as what are termed inner braiding material carriers of the rotational braiding machine.

The drive can have a first drive. The first drive can be designed to drive an outer rotor. The outer rotor can be designed to support the first braiding material carriers and rotate them in the first rotation direction about the common braiding center.

According to a first possible realization, the rotational braiding machine can have a differential gear connected downstream of the first drive. The differential gear can be designed to drive an inner rotor. The inner rotor can be designed to support the second braiding material carriers and rotate them in the second rotation direction about the common braiding center.

According to a second possible realization, the drive can have a second drive. The second drive can be designed to drive an inner rotor. The inner rotor can be designed to support the second braiding material carriers and rotate them in the second rotation direction about the common braiding center. The first and/or second braiding material carriers can run circularly about the common braiding center, i.e., be arranged along a circumference about the common braiding center. The first braiding material carriers can be arranged each spaced uniformly from one another in a circumferential direction about the common braiding center. The second braiding material carriers can be arranged each spaced uniformly from one another in a circumferential direction about the common braiding center. The first and/or second braiding material carriers can be bobbins on which the braiding material can be wound up, for example. The first braiding material carriers can be arranged respectively at an identical, first distance from the braiding center in a radial direction. The second braiding material carriers can be arranged respectively at an identical, second distance from the braiding center in a radial direction. The first and the second distance can be the same or different. The first distance can be greater than the second distance. The radial distance of the first and/or second braiding material carriers from the braiding center can be constant/invariable or variable. The first and/or second braiding material carriers can be provided with an identical quantity of braiding material or a quantity at least partly differing from one another. In the braiding center, the braiding material supplied respectively by the first and/or second braiding material carriers is braided with one another. The braiding center can also be described as the braiding axis of the braiding machine. The braiding center can lie parallel to the longitudinal axis of the braiding machine or correspond to this.

The braiding material can be any conceivable stranded or elongated material suitable for a braiding process. Various braids can therefore be produced by means of the rotational braiding machine from stranded material such as wires or textile fibers, for example in the form of braided hoses or plaited braids and/or for braiding a cable, for example, with a wire braid. The rotational braiding machine can be a wire braiding machine especially suited to braiding wires, for example.

A complete process for producing a braided product can be understood by a braiding process. It is conceivable, furthermore, that a braiding process can be understood as a process lasting from starting of the rotational braiding machine to stopping of the braiding machine. The rotational braiding machine is stopped, for example, if one or more of the braiding material carriers has run out and is replaced by a full braiding material carrier, i.e., one completely filled with braiding material.

To control the drive, a control device can be provided as controller. The control device can be designed to control the respective drive and to specify and/or adjust the respective rotational speed. The respective drive can receive corresponding control instructions from the control device for this. The respective drive can drive the braiding material carriers accordingly based on the control instructions.

Even if reference is made herein to the rotational speed in place of the angular velocity or path velocity, these statements apply correspondingly also to the angular velocity or path velocity. The control device can be designed to adjust the respective rotational speed several times/repeatedly during a braiding process.

The method described can be carried out entirely or partially by means of a computer program. A computer program product can thus be provided with program code sections for executing the method. The computer program can be stored on a computer-readable storage medium or in the braiding machine. If the program code sections of the computer program are loaded into a calculator, computer or processor (for example a microprocessor, microcontroller or digital signal processor (DSP)), or run on a calculator, computer or processor, they can cause the computer or processor to execute one or more steps, or all steps of the method described herein.

Even if some of the aspects and details described above were described in relation to the braiding machine, these aspects can also be realized in a corresponding manner in the method for operating the braiding machine or a computer program supporting or implementing the program.

BRIEF DESCRIPTION OF THE DRAWINGS

The present invention is to be explained further on the basis of figures. These figures show schematically.

DETAILED DESCRIPTION

In the following, specific details are set out, without being restricted hereto, to deliver a complete understanding of the present invention. It is clear to an expert, however, that the present invention can be used in other exemplary embodiments that may differ from the details set out below. For example, the figures are described principally in regard to one exemplary embodiment in that a cam ring is used as a unit for movement of the relocating elements. The invention is not restricted to this exemplary embodiment, however. An exemplary embodiment is thus possible, for example, in which the relocating elements are moved via one or more drives.

It is also clear to the expert that the explanations set out below are/can be implemented using hardware circuits, software means or a combination thereof. The software means can be associated with programmed microprocessors or a general calculator, computer, an ASIC (application-specific integrated circuit) and/or DSPs (digital signal processors). It is also clear that even if the following details are described in relation to a method, these details can also be realized in a suitable device unit, a computer processor or a memory connected to a processor, wherein the memory is provided with one or more programs that carry out the method when they are executed by the processor.

Figure 1A:
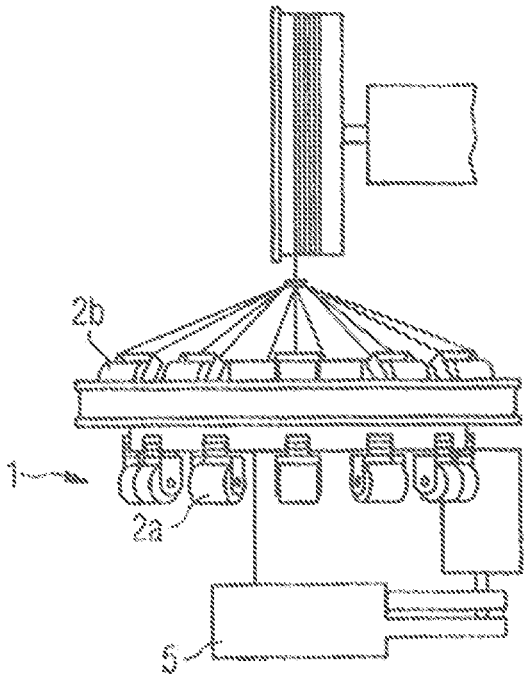
FIG. 1*a* a schematic illustration of an example rotational braiding machine.
Figure 1B:
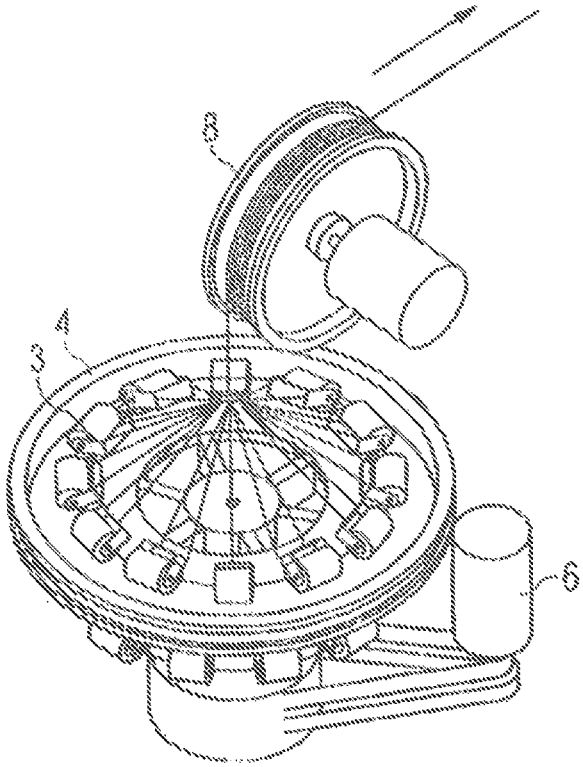
FIG. 1*b* a front view of the rotational braiding machine of FIG. 1*a;*

FIGS. 1*a*-1*b* show a schematic representation of an example rotational braiding machine 1. The rotational braiding machine 1 has two groups of braiding material carriers, which are described below by way of example as bobbin carriers 2*a*, 2*b*. In the rotational braiding technique, and the special form of the lever arm braiding technique, as shown in FIG. 1*a* as an example, two groups of bobbin carriers 2*a*, 2*b* on which the braiding material, which is described below by way of example as wire, is stored by bobbins, each move in opposite directions on a circular path about a braiding center. The rotational braiding machine 1 is described below in some cases also as a lever arm braiding machine or lever braiding machine 1. Special lever arm braiding machines, so-called rapid braiding machines according to the horn system, currently achieve the highest processing speed. Due to the fact that no yarn length compensation has to take place, they simultaneously enable the most precise control of yarn tension and thus an excellent quality of the braided product.

The two paths on which the bobbin carriers 2*a*, 2*b* move are arranged so that the wire from the upper bobbin carriers and thus the upper bobbins of one rotation direction are drawn off directly to the braiding point. This path is termed the inner bobbin path below and executes a simple rotatory movement. The upper bobbin carriers 2*b* are therefore often also termed inner bobbin carriers 2*b*. The wire from the lower bobbin carriers 2*a* and thus the lower bobbins is now guided alternately above or below past the bobbin carrier(s) 2*b* approaching on the inner path by means of a respective relocating element which, on account of the exemplary configuration of the rotational braiding machine in FIG. 1*a* as a lever arm braiding machine, is designed as relocating lever 3. The lower bobbin carriers are often termed outer bobbin carriers 2*a*. The related path of the outer bobbin carriers 2*a* is accordingly often termed the outer path. So that the relocating levers 3 can complete such an oscillating upward and downward movement, these are moved, e.g., by means of sliding slide blocks, which slide in a curved path fixedly positioned in space. This curved path is located in the inside of a cam ring 4. The central shaft 5 of the rotational braiding machine 1 is likewise fixedly positioned in space. In the example shown, these two components are connected fixedly to one another by way of example for the purpose of being able to explain them more simply. The cam ring 4 serves to move the relocating levers 3. The movement takes place during a braiding process and, with the rotational braiding machine 1, invariably according to the configuration of the curved path in the cam ring 4. This means that if the movement of the relocating levers 3 is to be adjusted, the cam ring 4 must be replaced by a cam ring with a differently configured curved path.

A rotary movement is transmitted by a drive motor 6 of the rotational braiding machine 1 by parallel belt drive to the shafts located in the central shaft/bearing assembly 5 in order to set in rotation the outer or inner rotor located at the other end as well as outer bobbin path and thus outer bobbin carriers 2*a* or inner bobbin path and thus inner bobbin carriers 2*b*. These two belt drives serve to adjust the rotational speed to the effect that on the output side both bobbin paths and thus both the bobbin carriers 2*a* and the bobbin carriers 2*b* have the same rotational speed in terms of amount. This can be realized alternatively by only one belt and downstream gearwheel gear. This rotary movement is transmitted via planetary gears from the outer rotor (at rotational speed $n_A$) with an opposite direction of rotation to the inner bobbin path (at rotational speed $n_I$). Both paths accordingly have the same rotational speed in terms of amount ($|n_A|=|n_I|$). On a take-off wheel 8, which is driven by an electric motor, the product to be braided is drawn off by means of multiple looping by the lever arm braiding machine at speed $v_A$.

Stated more precisely, in the case of a lever arm braiding machine 1 as a special example of the rotational braiding machine 1, as described, two rotors, the inner rotor and the outer rotor, are placed on the central shaft 5. Both are rotated via a drive motor/drive 6 in the same direction, but at different speeds/rotational speeds coordinated to one another. For this, gearwheels of different sizes can be used for the drive. Due to a differential gear, which can have a small gearwheel, the inner rotor and the inner bobbin carriers 2*b*, the bobbin carriers 2*b* of the inner circle get an opposite rotation direction to the outer circle/the outer bobbin carriers 2*a* with the same rotational speed in terms of amount. The outer rotor supports the outer bobbins 2*a*. Associated with each outer bobbin 2*a* is a relocating lever 3, which is supported rotatably on the outer rotor. At the same time, this rotor (the outer rotor) constitutes the sliding path for the bobbin carriers 2*b* of the inner bobbin circle. The outer rotor also contains, for example, sliding path recesses into which the wires of the outer bobbins can be lowered. Each of the relocating levers 3 engages, for example, with a sliding element in the guide groove of the cam ring 4. On known lever arm braiding machines, the cam ring/groove cam ring 4 is fixed. The relocating levers 3 are controlled in each case by the groove cam ring 4. Here the relocating levers 3 for the outer wire are formed such that the lever tip can move on an imaginary ball surface spanned about the braiding point. The wires guided via the lever 3 thus always have the same path length to cover to the braiding point, so that no yarn length compensation is required in the lever arm braiding machine 1. Due to the rotation of the outer rotor, the corresponding sliding element of each relocating lever 3 is pushed through the guide groove of the cam ring 4 and moved up and down thereby. The course of the groove dictates how often the lever 3 can change its position during a circuit. The interlacing pattern of the braid 10 is set in this way (see FIG. 1*c*). Since the respective relocating lever 3 and the sliding path with the recesses are both fixed on the outer rotor, no positioning problems occur, and the wire is always lowered exactly into the respective recess. So that the bobbin carriers 2*b* of the inner bobbin circle move in the opposite direction about the machine center, these are pushed into the opposite direction via gearwheels supported on the outer rotor, for example. These gearwheels are driven e.g., by ring toothing on the inner rotor, which rotates twice as fast as the outer rotor, so that the bobbins circulate about the braiding center opposite the rotation direction of the sliding path at a speed that is the same in terms of amount. This design principle gives rise to a relative speed between bobbin carriage and sliding path that is twice as great as the speed of the sliding path itself.

Since the braid on a conventional rapid braider 1 runs along the product axis, the rotational speeds are related to one another as follows:

$$n_A=-n_I$$

$$0=n_A+n_I$$

The braiding pitch $s_G$ of this braider is calculated as follows:

$$s_G=v_A/n_A$$

Figure 1C:
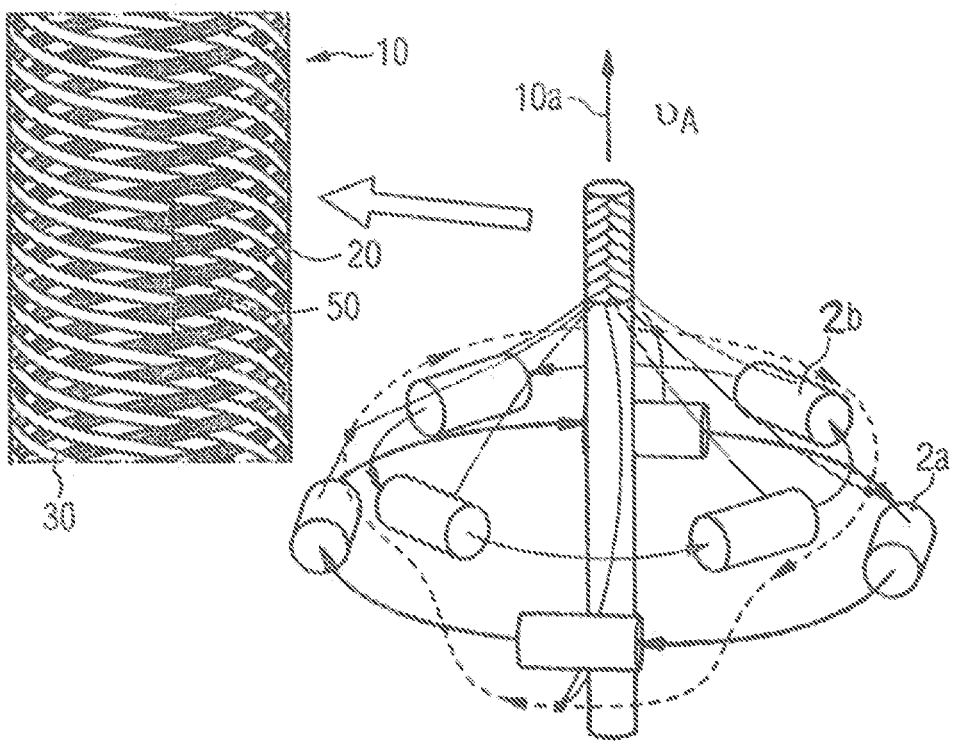
FIG. 1*c* an explanation of the functional principle of the rotational braiding machine from FIG. 1*a* and an example of a braid produced using the rotational braiding machine from FIG. 1*a;*

In the construction described in relation to FIG. 1*a*, the interlacing of the approaching wires takes place at the point where a deviation is introduced in the case of the curved path fixedly positioned in space (see FIG. 1*c*). For the sake of simplicity, the curve progression is explained in FIG. 1*c* by way of example in the case of just one wire interlacing (crossover) of a braid 10.

In FIG. 1*c*, a braid 10 is to be seen schematically that can be produced by means of the rotational braiding machine 1 from FIG. 1*a*. The braid 10 can be a cable shield, for example, more precisely a braided shield for a cable. The braid 10 has a first wire winding 20, which extends in a first rotation direction with a first pitch spirally in the direction of a longitudinal axis 10*a* of the braid 10. Expressed another way, seen from the lower end of the braid 10, i.e., in the direction of the arrow of the longitudinal axis 10*a* of the braid 10 and the rotational braiding machine 1, the first wire winding 20 coils counterclockwise upwards with a first pitch. The braid 10 has a second wire winding 30, which extends in a second rotation direction with a second pitch spirally in the direction of the longitudinal axis 10*a* of the braid 10. Expressed another way, seen from the lower end of the braid 10, i.e., in the direction of the arrow of the longitudinal axis 10*a*, the second wire winding 30 coils clockwise upwards with a second pitch. In the example from FIG. 1*c*, the first pitch corresponds to the second pitch.

As is to be recognized in FIG. 1*c*, a turn of the first wire winding 20 and a turn of the second wire winding 30 overlap at one point. This point is described as the crossing point or overlap point. In the example from FIG. 1*c*, the two wire windings 20, 30 are intertwined with one another at the crossing point. Since each of the wire windings 20, 30 has a plurality of turns in the direction of the longitudinal axis 10*a*, a plurality of such crossing points exists in the direction of the longitudinal axis 10*a*, even in the case of one crossing point per turn. In the example from FIG. 1*c*, it is to be recognized that these crossing points lie on a straight line 50 which runs parallel to the direction of the longitudinal axis 10*a*. Due to the braiding, the two wire windings 20, 30 form two layers, so to speak, and can accordingly also be termed two-layer wire covering and, on account of the parallelism of the crossing points to the longitudinal axis, as two-layer wire covering with intersection running axially.

The wires/wire windings 20, 30 of the braid 10 from FIG. 1*c* experience a movement relative to one another with accompanying friction when they are exposed to movement. Furthermore, these wires/wire windings 20, 30 experience tractive and thrust loads. This gives rise to a limited service life of the wires/wire windings 20, 30 and thus of the braid 10. Although the braid 10 from FIG. 1*c* with the opposed wire covering shown has a relatively high mechanical service life and a higher mechanical service life than conventional braids, for example of wires with the same orientation, the braid 10 can move, or more precisely, the wires of the braid 10 can move and form, e.g., nests and holes. This has a negative influence on the electrical properties of the braid 10.

Figure 2A:
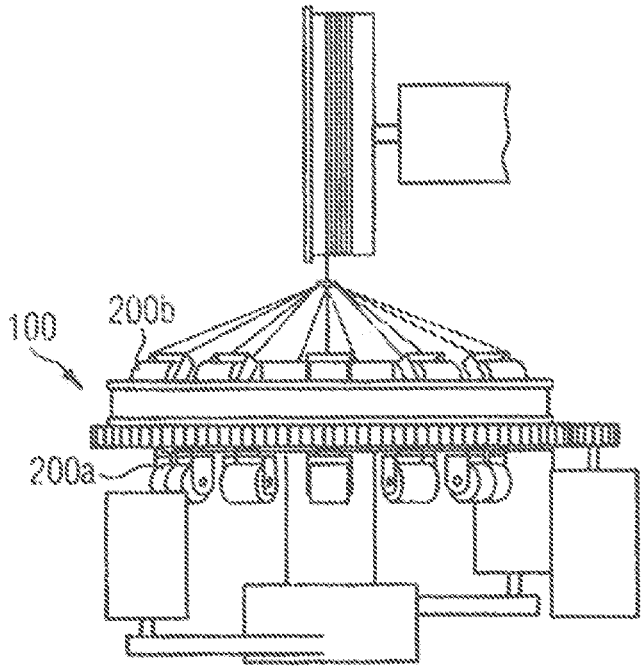
FIG. 2*a* a schematic illustration of another example rotational braiding machine according to an exemplary embodiment of the invention.
Figure 2B:
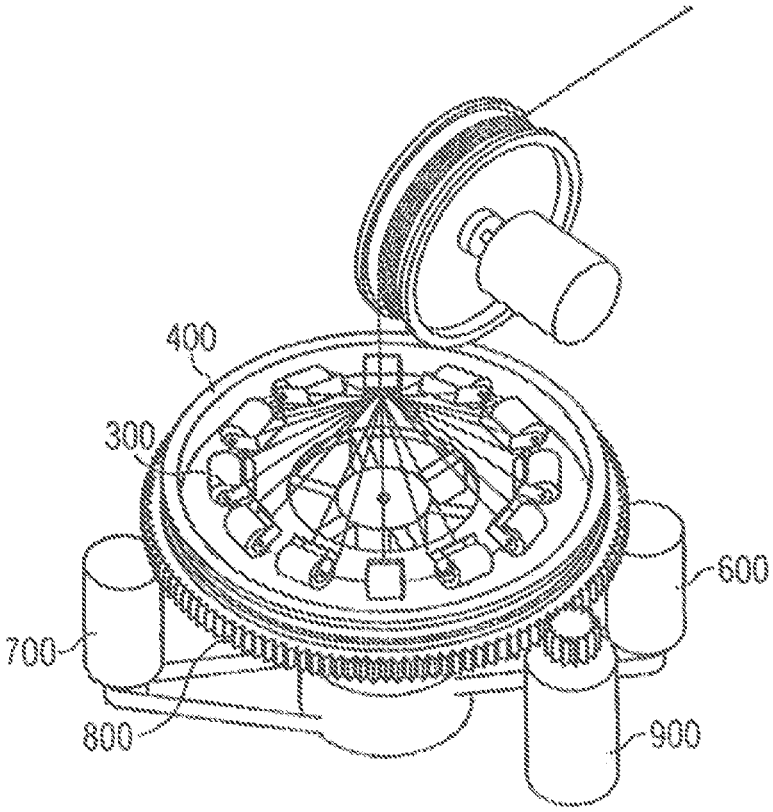
FIG. 2*b* a front view of the rotational braiding machine of FIG. 2*a;*

FIGS. 2*a*-2*b* show another example rotational braiding machine 100 according to an exemplary embodiment of the invention. The rotational braiding machine 100 is configured as an example as a lever braiding machine/lever arm braiding machine. Other configurations are conceivable with suitable adjustments. The lever braiding machine 100 from FIG. 2*a* is based on the lever braiding machine 1 described in relation to FIG. 1*a*, so that the common features of these two braiding machines 1, 100 are not highlighted separately. The details described in relation to the lever braiding machine 1 from FIG. 1*a* apply accordingly also to the lever braiding machine 100 from FIG. 2*a*. As a significant difference between the two lever arm braiding machines 1, 100 from FIGS. 1*a* and 2*a* it can be stated that the cam ring 4 of the lever arm braiding machine 1 from FIG. 1*a* is stationary, while the cam ring 400 of the lever arm braiding machine 100 from FIG. 2*a* is not stationary, more precisely it rotates. As will be explained more precisely later, the movement of the relocating levers 300 of the rotational braiding machine 100 can be adjusted by the movement of the cam ring 400.

On the rotational braiding machine 100, the bobbin carriers 200*a*, 200*b* rotate uniformly about the braiding center. This rotational braiding technique permits high production speeds and is therefore also called a high-speed braiding technique. In this rotational braiding technique, two groups of bobbin carriers 200*a*, 200*b*, stored on which is the braiding material wire, as in the example from FIG. 2*a*, each move on a circular path in opposite directions about the braiding center. The two paths are arranged so that the braiding material, e.g., the wire, is drawn off from the bobbin carriers 200*b* of one circulation direction directly to the braiding point. This path is described below as the "inner" path and the corresponding bobbin carriers as inner bobbin carriers 200*b*. The braiding material coming from the bobbins of the other—here termed "outer"—path, more precisely the outer bobbin carriers 200*a* of the outer path, must now be guided past above or below the bobbins approaching on the inner path or vice versa to achieve the interlacing of the braid.

The lever braiding machine 100 has a drive 600. The drive 600 transfers its rotary movement to the outer rotor. In contrast to the fixed position in space of the cam ring 4 from FIG. 1*a*, the cam ring 400 is supported on a slewing ring 800. The axis of rotation of the slewing ring 800 corresponds to the axis of the braiding center. By means of an electric drive 900 the slewing ring 800 and thereby the cam ring 400 experience a rotary movement with the rotational speed $n_K$. In FIG. 2*a*, the drive of the cam ring 400 is achieved by a gear drive. The gear drive is connected on its input side to the electric drive 900 and is driven by the electric drive 900. On its output side, the gear drive is connected (directly) to the slewing ring 800 and thus (indirectly) to the cam ring 400, i.e., due to movement/rotation of the gear drive, the slewing ring 800 and the cam ring 400 move/rotate. Alternatively to the gear drive, the cam ring 400 can experience a rotary movement with rotational speed $n_K$ by means of the electric drive 900 via a belt drive.

In the braiding process, the rotational speed $n_K$ of the cam ring 400 is the definitive rotational speed. So that the relocating levers 300 of the outer bobbin carriers 200*a* can be raised and lowered over the curved path of the cam ring 400 in an oscillating manner, the rotational speed of the outer rotor and thus the rotational speed of the outer bobbin carriers 200*a* must be coordinated to the cam ring 400. For a functioning process to produce the braid 1000 itself (see FIG. 2*c*), the rotational speed $n_K$ is therefore added to the rotational speed $n_A$ of the outer rotor from FIG. 1*a* as actual rotational speed $n_{Anew}$ of the outer rotor. The rotational speed $n_K$ of the cam ring is taken into positive account, so to speak, in the actual rotational speed $n_{Anew}$ of the outer rotor and thus of the outer bobbin carriers 200*a*. This thereby results for the new rotational speed $n_{Anew}$ of the outer rotor from FIG. 2*a* in:

$$n_{Anew}=n_A+n_K$$

Due to the rotation of the cam ring 400, furthermore, the rotational speed of the inner rotor is adjusted so that the rotational speed $n_K$ of the cam ring 400 is taken into account for the rotational speed of the inner rotor. For the rotational speed $n_{Inew}$ of the inner rotor and thus the rotational speed of the inner bobbin carriers 200*b*, the rotational speed $n_K$ of the cam ring 400 is taken into account negatively, so to speak. The inner rotor from FIG. 2*a* is therefore operated likewise at a changed rotational speed $n_{Inew}$, therefore, by comparison with the inner rotor from FIG. 1*a*.

To drive the inner rotor at the adjusted rotational speed relative to FIG. 1*a*, the lever arm braiding machine from FIG. 2*a* can have an additional drive 700, as shown by way of example in FIG. 2*a*. The additional drive 700 transfers the rotational speed $n_{Inew}$ to the inner rotor via a belt. This is calculated as follows:

$$N_{Inew}=-n_A+n_K$$

$$n_{Inew}=-n_{Anew}+2*n_K$$

Instead of the drive 700, the rotational speed $n_{Inew}$ can also be realized by downstream connection of a differential gear at the drive 600. The point of the curved path deviation and the resulting interlacing of the wires is changed radially (see FIG. 2*c*) by this rotary movement. More precisely, as rotation proceeds, the relative position of the wires of the outer bobbins/bobbin carriers 200*a* and the wires of the inner bobbins/bobbin carriers 200*b* changes relative to one another, so that the respective crossing point changes as rotation proceeds. The movement of the relocating levers 300 can be adjusted by adjustment of the rotary movement(s) and thus the interlacing of the wires changed. Flexible interlacing patterns can be achieved in this way.

Figure 2C:
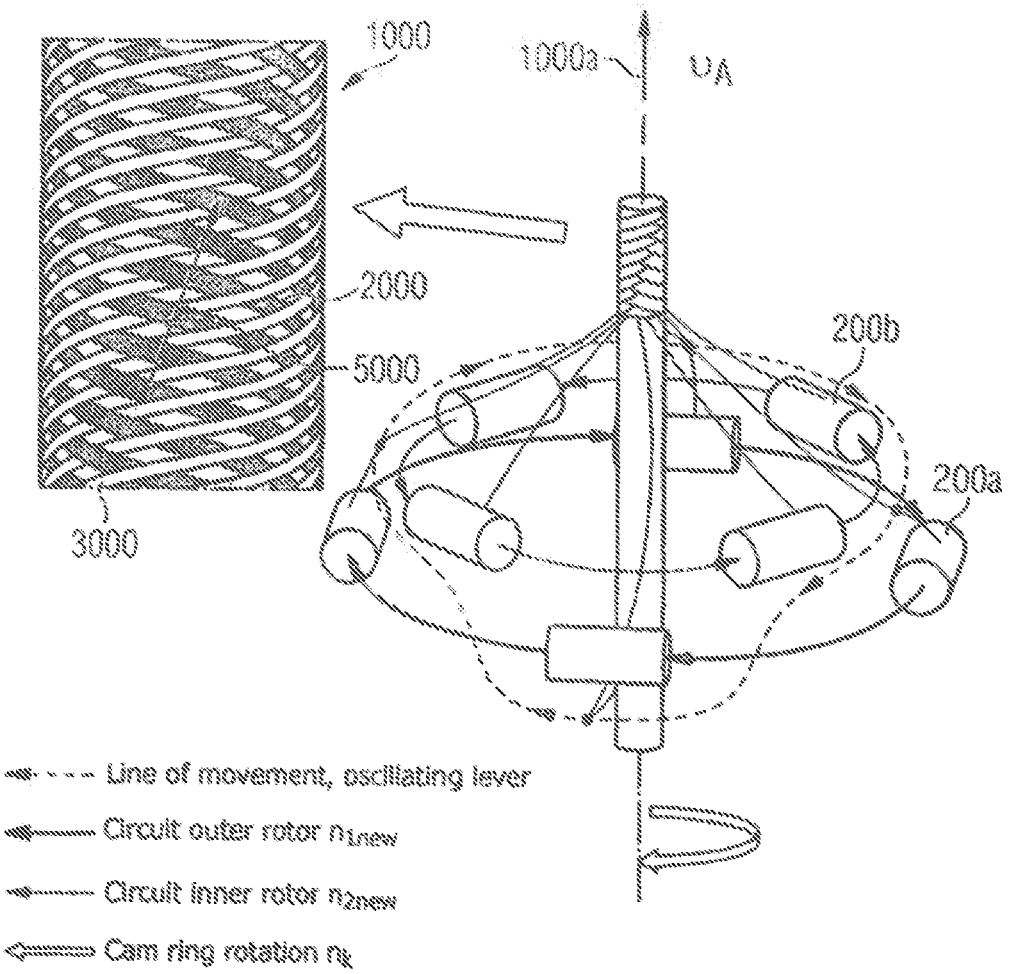
FIG. 2*c* an explanation of the functional principle of the rotational braiding machine from FIG. 2*a* and an example of a braid produced using the rotational braiding machine from FIG. 2*a.*

While the rotational speeds $n_A$, $n_I$ of the outer bobbin carriers 2*a* and inner bobbin carriers 2*b* match in terms of amount on the rotational braiding machine from FIGS. 1*a*-1*c*, the rotational speeds $n_{Anew}$, $N_{Inew}$ of the outer bobbin carriers 200*a* and inner bobbin carriers 200*b* on the braiding machine 100 from FIGS. 2*a*-2*c* do not match in terms of amount if $n_K$ is not equal to 0.

The newly introduced rotary movement of the cam ring with its rotational speed $n_K$ together with the drawing-off speed $v_A$ of the draw-off wheel forms the helix pitch $$s_W$$

$$s_W=v_A/n_K$$

To produce the braid 1000 with rotating cam ring 400, the following calculation is applied:

$$s_G=v_A/(n_A+n_K)$$

$$s_G=v_A/n_{Anew}$$

The production of the braid 1000 is described more precisely in relation to FIG. 2*c*. The dashed relocating path represents that the wire coming from the outer bobbins/bobbin carriers 200*a* switches multiple times from the lower to the upper position in the course of one circling of the braiding machine center, so that the inner bobbins/bobbin carriers 200*b* can pass below or above. The change of position does not have to take place after every passing of a bobbin/bobbin carrier of the other running direction. Several can also be passed consecutively. The weave construction of the braid can be influenced in this way. The control of the yarn is realized by means of a so-called relocating unit, the constructional implementation of which differs depending on the construction principle of the machine. In the simplest case, relatively rigid guide plates are involved here, which are called deflectors. In other cases, the wire is moved actively via mechanical relocation. This principle is used on the lever arm braiding machine 100 depicted as an example in FIGS. 2*a*-2*c*.

On the lever arm braiding machine 100 from FIGS. 2*a*-2*c*, the outer wires are guided via deflection levers/relocating levers 300, which execute periodic up and down movements during circling of the center. Whenever the lever 300 with the outer wire guided via this is located at the high point, an inner bobbin carrier 200*b* circling in the opposite direction can slide through under the wire. Following this, the lever 300 moves into its lower position and the wire is lowered, for example, into an indentation in the inner guide track before the following inner bobbin carrier 200*b* arrives there, so that it can then slide over it. The braid 1000 is formed in this way.

FIG. 2*c* shows schematically a braid 1000, for example a braided shield for a cable that can be produced using the lever arm braiding machine 100 from FIG. 2*a*. The braid 1000 has improved characteristics compared with the braid from FIG. 1*c*. The braid 1000 has a first wire winding 2000, which extends in a first rotation direction with a first pitch spirally in the direction of a longitudinal axis 1000*a* of the braid 1000. Expressed another way, seen from the lower end of the braid 1000, i.e., in the direction of the arrow of the longitudinal axis 1000*a*, the first wire winding 2000 coils counterclockwise upwards with a first pitch. The braid 1000 has a second wire winding 3000, which extends in a second rotation direction with a second pitch spirally in the direction of the longitudinal axis 1000*a* of the braid 1000. Expressed another way, seen from the lower end of the braid 1000, i.e., in the direction of the arrow of the longitudinal axis 1000*a*, the second wire winding 3000 coils clockwise upwards with a second pitch. In the example from FIG. 2*c*, the first pitch corresponds to the second pitch, i.e., each individual complete turn of the wire windings 2000, 3000 covers the same path W in the direction of the longitudinal axis 1000*a*. A turn describes a complete revolution of a wire of the respective wire winding 2000, 3000 in this case.

As is to be recognized in FIG. 2*c*, a turn of the first wire winding 2000 and a turn of the second wire winding 3000 overlap at one point. This point is described as the crossing point or overlap point. In the example from FIG. 2*c*, the two wire windings 2000, 3000 are intertwined with one another at the crossing point. Since each of the wire windings 2000, 3000 has a plurality of turns in the direction of the longitudinal axis 1000*a*, a plurality of such crossing points exists in the direction of the longitudinal axis 1000*a*, even in the case of one crossing point per turn. In the example from FIG. 2*c*, it is to be recognized that these crossing points run in the shape of a helix 5000 or spiral, i.e., do not form a straight line running parallel to the direction of the longitudinal axis 1000*a*. Due to the braiding, the two wire windings 2000, 3000 form two layers, so to speak, and can accordingly also be termed two-layer wire covering and, on account of the helical progression 5000 of the crossing points, as two-layer wire covering with intersection running helically.

For the sake of simplicity and clarity, only one crossing point per turn, more precisely per turn of the wire winding 2000 and corresponding turn of the wire winding 3000, is shown in FIG. 2*c*. A turn of the wire winding 2000 and a corresponding turn of the wire winding 3000 can cross at more than one point, however, i.e., at several points, i.e., have several crossing points respectively at which they are intertwined with one another. For example, the wire winding 2000 and the wire winding 3000 are intertwined with one another at one or more, e.g., at each, of their turns not only once, but twice or if applicable several times and accordingly have a first crossing point, a second crossing point and if applicable further crossing points per turn. In this case a plurality of first crossing points, a plurality of second crossing points and if applicable a plurality of further crossing points are present in the direction of the longitudinal axis 1000*a*. The plurality of first crossing points can be described by a first helix/spiral 5000 in the direction of the longitudinal axis 1000*a*. The plurality of second crossing points can be described by a second helix/spiral in the direction of the longitudinal axis 1000*a* that runs parallel to the first helix/spiral 5000. The plurality of further crossing points can be described by a further helix/spiral in the direction of the longitudinal axis 1000*a* that runs parallel to the first helix/spiral 5000 and the second helix/spiral.

The braid 1000 described in relation to FIG. 2*c* with overlap points running helically is more stable against drag, torsional and flexural fatigue movement than the braid 10 with overlap points running axially and described with regard to FIG. 1*c*. A shielding as a combination of wire covering and braid can be provided by the braid 1000 that is intertwined with itself, per turn pair, only at one point of the circumference or at several points of the circumference. The intertwined point(s) runs/run helically along the longitudinal axis 1000*a*, such as, e.g., the product axis, of the braid 1000. This increases the service life of the braid 1000, as the shielding of cables, in the event of mechanical stress in two or three dimensions. Better electrical properties (i.e., a better electrical performance) are additionally achieved thus over the service life (e.g., in respect of EMC, leakage currents etc.).

By stopping the drive 900 together with corresponding control of the drives 600 and 700, a braiding operation can be possible accordingly without helix production. For example, by stopping the drive 900, the cam ring 400 can assume a fixed/non-rotating position. By corresponding control of the drives 600, 700, the rotational speed of the outer rotor and the inner rotor can be adjusted, for example, such that it corresponds to the rotational speeds of the outer rotor and inner rotor from FIG. 1*a*. In this case a braid results as shown in FIG. 1*c*. Other braids with crossing points running differently are conceivable. At any rate, a braid can be manufactured flexibly, in particular a braid with variable crossing progression, by adjustment of the rotational speeds $n_K$, $n_I$, $n_A$.

Alternatively to the rotational braiding machine 100 described with regard to FIG. 2*a*, the braid 1000 can also be produced using a rotational braiding machine on which the cam ring 400 is dispensed with and instead the movement of the relocating levers 300 is adjusted. A combination of adjustment of the movement of the relocating levers 300 and rotatable cam ring 400 is also conceivable. As an example, let it be said at this point that each of the relocating levers 300 can be connected to a drive, e.g., a servomotor or electromagnetic drive. Each of the drives can control its related relocating lever 300 according to control commands received from a controller. The drives of the relocating levers 300 can be arranged respectively on their associated relocating lever 300, for example, or connected to this.

It is conceivable, for example, that the drives are controlled so that the relocating levers 300 execute a fully continuous movement. In this case the rotational braiding machine 1000 can produce a braid 10 from FIG. 1*c*. In addition or alternatively, it is conceivable that the drives are controlled such that the relocating levers 300 do not execute a fully continuous movement. For example, following a complete run from the first position to the second position and back into the first position, one or each of the relocating levers 300 can be stopped/held briefly before the drive or before the drives starts/start a fresh complete run of the relocating levers 300. The next crossover of the braiding material can be delayed by the brief holding, so that the crossing points shift, as in the braid from FIG. 2*b*. A helical progression of the crossing points can be achieved in this way, as in FIG. 2*c*.

The drives can be activated entirely flexibly, so that various braid patterns/interlacing patterns of a braid can be achieved. The drives can also be controlled differently, at least in some cases, so that the various relocating levers 300 can execute different movement courses, at least in some cases.

The invention claimed is:

1. A rotational braiding machine (100) having:

a plurality of first braiding material carriers (200*a*), which are arranged around a common braiding center of the rotational braiding machine (100) and are each designed to carry a braiding material to be braided in the common braiding center;

a plurality of second braiding material carriers (200*b*), which are arranged around the common braiding center of the rotational braiding machine (100) and are each designed to carry a braiding material to be braided in the common braiding center;

a movement unit, which is arranged and designed to move relocating elements (300) associated respectively with the first braiding material carriers between a first position and a second position in each case, wherein each of the relocating elements (300) is able to raise the braiding material in the first position such that at least one of the plurality of second braiding material carriers (200*b*) can pass under the raised braiding material, and wherein each of the relocating elements (300) is able to lower the braiding material in the second position such that at least one of the plurality of second braiding material carriers (200*b*) can pass over the lowered braiding material, wherein the movement unit has a rotatable cam ring (400) or is designed as a rotatable cam ring (400);

a drive, which is designed to:

drive the plurality of first braiding material carriers (200*a*) such that they rotate in a first rotation direction about the common braiding center, and drive the plurality of second braiding material carriers (200*b*) such that they rotate in a second rotation direction different from the first rotation direction about the common braiding center;

wherein the drive has a cam ring drive (900), which is designed to drive the cam ring (400) such that the cam ring (400) rotates in the first rotation direction about the common braiding center at the cam ring rotational speed;

a controller, which is designed to:

control the movement unit such that the movement of at least one of the relocating elements (300) is adjustable.

2. The rotational braiding machine (100) according to claim 1, wherein the controller is designed to control the movement unit in that the controller causes the drive to drive the rotatable cam ring (400) such that the rotatable cam ring (400) rotates in the first rotation direction about the common braiding center at a cam ring rotational speed;

cause the drive to drive the plurality of first braiding material carriers (200*a*) such that they rotate in the first rotation direction about the common braiding center at a first rotational speed taking account of the cam ring rotational speed, and cause the drive to drive the plurality of second braiding material carriers (200*b*) such that they rotate in a second rotation direction different from the first rotation direction about the common braiding center at a second rotational speed taking account of the cam ring rotational speed.

3. The rotational braiding machine (100) according to claim 1, wherein the cam ring drive is designed as an electric drive.

4. The rotational braiding machine (100) according to claim 1, wherein the rotational braiding machine (100) further has a slewing ring (800), the axis of rotation of which corresponds to the braiding center, wherein the cam ring (400) is supported on the slewing ring (800).

5. The rotational braiding machine (100) according to claim 4, wherein the rotational braiding machine (100) further has a gear connected to the cam ring drive (900) and to the slewing ring (800), wherein the gear is designed to transmit the energy supplied by the cam ring drive to the slewing ring.

6. The rotational braiding machine (100) according to claim 5, wherein the gear is formed as a belt drive or gear drive.

7. The rotational braiding machine (100) according to claim 1, wherein the movement unit comprises at least one drive associated with the relocating elements (300) for helping control movement thereof.

8. The rotational braiding machine (100) according to claim 7, wherein the controller is designed to control the movement unit in that the controller causes the at least one drive to adjust the movement of the relocating elements (300).

9. The rotational braiding machine (100) according to claim 1, wherein the first braiding material carriers (200*a*) are designed as outer braiding material carriers of the rotational braiding machine (100) and the second braiding material carriers (200*b*) are designed as inner braiding material carriers of the rotational braiding machine (100).

10. The rotational braiding machine (100) according to claim 1, wherein the drive has a first drive (600), which is designed to drive an outer rotor, wherein the outer rotor is designed to carry the first braiding material carriers (200*a*) and to rotate them in the first rotation direction about the common braiding center.

11. The rotational braiding machine (100) according to claim 1, wherein the drive has a second drive (700), which is designed to drive an inner rotor, wherein the inner rotor is designed to carry the second braiding material carriers (200*b*) and to rotate them in the second rotation direction about the common braiding center.

12. Method for controlling a rotational braiding machine (100), wherein the rotational braiding machine (100) has a plurality of first braiding material carriers (200*a*), a plurality of second braiding material carriers (200*b*), a movement unit, a drive and a controller, wherein the plurality of first braiding material carriers (200*a*) is arranged around a common braiding center of the rotational braiding machine (100) and is designed in each case to carry a braiding material to be braided in the common braiding center, wherein the plurality of second braiding material carriers (200*b*) is arranged around the common braiding center of the rotational braiding machine (100) and is designed in each case to carry a braiding material to be braided in the common braiding center, wherein the movement unit is arranged and designed to move relocating elements (300) associated respectively with the first braiding material carriers (200*a*) between a first position and a second position in each case, wherein each of the relocating elements (300) is able to raise the braiding material in the first position such that at least one of the plurality of second braiding material carriers (200*b*) can pass under the raised braiding material, and wherein each of the relocating elements (300) is able to lower the braiding material in the second position such that at least one of the plurality of second braiding material carriers (200*b*) can pass over the lowered braiding material, wherein the movement unit has a rotatable cam ring (400) or is designed as a rotatable cam ring (400), wherein the method has the steps:

driving of the plurality of first braiding material carriers (200*a*) such that the plurality of first braiding material carriers (200*a*) rotates in a first rotation direction about the common braiding center;

driving of the plurality of second braiding material carriers (200*b*) such that the plurality of second braiding material carriers (200*b*) rotates in a second rotation direction different from the first rotation direction about the common braiding center; and control of the movement unit such that the movement of at least one of the relocating elements (300) is adjustable, wherein the drive has a cam ring drive (900), which is designed to drive the cam ring (400) such that the cam ring (400) rotates in the first rotation direction about the common braiding center at the cam ring rotational speed.

13. A rotational braiding machine (100) having:

a plurality of first braiding material carriers (200*a*), which are arranged around a common braiding center of the rotational braiding machine (100) and are each designed to carry a braiding material to be braided in the common braiding center;

a plurality of second braiding material carriers (200*b*), which are arranged around the common braiding center of the rotational braiding machine (100) and are each designed to carry a braiding material to be braided in the common braiding center;

a movement unit, which is arranged and designed to move relocating elements (300) associated respectively with the first braiding material carriers between a first position and a second position in each case, wherein each of the relocating elements (300) is able to raise the braiding material in the first position such that at least one of the plurality of second braiding material carriers (200*b*) can pass under the raised braiding material, and wherein each of the relocating elements (300) is able to lower the braiding material in the second position such that at least one of the plurality of second braiding material carriers (200*b*) can pass over the lowered braiding material, wherein the movement unit has a rotatable cam ring (400) or is designed as a rotatable cam ring (400) having a curved surface over which the relocating elements (300) pass to move between the first and second positions;

a drive, which is designed to:

drive the plurality of first braiding material carriers (200*a*) such that they rotate in a first rotation direction about the common braiding center, and drive the plurality of second braiding material carriers (200*b*) such that they rotate in a second rotation direction different from the first rotation direction about the common braiding center;

a controller, which is designed to:

control the movement unit such that the movement of at least one of the relocating elements (300) is adjustable.

* * * * *